US008651029B2

(12) United States Patent
Huang et al.

(10) Patent No.: US 8,651,029 B2
(45) Date of Patent: Feb. 18, 2014

(54) POTTING BENCH

(75) Inventors: Daiying Huang, Medina, MN (US); Samuel J. Clavette, Stillwater, MN (US); Stephanie A. Grotta, Minneapolis, MN (US); Sara L. Pedersen, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/222,715

(22) Filed: Aug. 31, 2011

(65) Prior Publication Data

US 2013/0047895 A1 Feb. 28, 2013

(51) Int. Cl.
*A47B 1/04* (2006.01)

(52) U.S. Cl.
USPC ..... 108/77

(58) Field of Classification Search
USPC ..... 108/65, 69, 77–82, 108, 152
See application file for complete search history.

(56) References Cited

U.S. PATENT DOCUMENTS

| | | | | |
|---|---|---|---|---|
| 2,798,732 | A | 7/1957 | Craig | |
| 2,922,176 | A * | 1/1960 | Bernhardt | 15/257.06 |
| 2,971,653 | A | 2/1961 | Shaw | |
| 3,239,272 | A * | 3/1966 | Wilkins | 297/160 |
| D244,819 | S | 6/1977 | Christen, Jr. | |
| 4,099,811 | A | 7/1978 | Barry | |
| D254,112 | S | 2/1980 | Handler et al. | |
| 4,357,881 | A * | 11/1982 | De Long | 108/49 |
| 4,392,436 | A * | 7/1983 | Weiler | 108/81 |
| D287,777 | S | 1/1987 | Hellwig et al. | |
| 4,934,280 | A | 6/1990 | Bae | |
| 5,090,398 | A * | 2/1992 | Raymer et al. | 126/41 R |
| D328,125 | S | 7/1992 | Bae | |
| D342,121 | S | 12/1993 | Lim | |
| 5,318,315 | A | 6/1994 | White et al. | |
| D348,573 | S | 7/1994 | Ewald | |
| 5,509,169 | A * | 4/1996 | Drucker | 15/257.06 |
| D377,127 | S | 1/1997 | Barrington | |

(Continued)

FOREIGN PATENT DOCUMENTS

FR 2534461 4/1984

OTHER PUBLICATIONS

"Cedar Potting Bench," printed from http://yumatusan.seesaa.net/article/142834139.html on Jul. 24, 2012 (4 pages).

(Continued)

*Primary Examiner* — Matthew Ing
(74) *Attorney, Agent, or Firm* — Leanne Taveggia Farrell; Westman, Champlin & Koehler, P.A.

(57) ABSTRACT

A potting bench includes an upper frame section and a lower frame section. The lower frame section is defined by a first front support, a first rear support, a second front support, a second rear support and a work surface. The work surface includes a fixed section having a first end and a second end, an extendable section rotatably coupled to the first end of the fixed section and configurable into a lowered and a raised position and a removable section configurable into a user work position and a stowed position. The first end of the removable section is located adjacent to the second end of the fixed section in the user work position and the removable section is supported on a support hook mounted on a side wall located between the second front support and the second rear support in the stowed position.

19 Claims, 18 Drawing Sheets

(56) References Cited

U.S. PATENT DOCUMENTS

| | | | | |
|---|---|---|---|---|
| D403,826 | S | 1/1999 | Tisbo et al. | |
| D406,431 | S | 3/1999 | Tisbo et al. | |
| 5,887,878 | A * | 3/1999 | Tisbo et al. | 280/47.19 |
| 6,086,073 | A | 7/2000 | Tisbo et al. | |
| D498,608 | S | 11/2004 | Lawson | |
| 6,860,494 | B1 | 3/2005 | Chisholm | |
| 7,137,223 | B1 | 11/2006 | Purcell | |
| 7,464,945 | B2 | 12/2008 | Humphries et al. | |
| 7,857,328 | B1 | 12/2010 | Boss | |
| 2004/0004334 | A1 | 1/2004 | Chen | |
| 2008/0296245 | A1 * | 12/2008 | Punzel et al. | 211/153 |
| 2009/0212678 | A1 | 8/2009 | Sung | |
| 2010/0018442 | A1 | 1/2010 | Knudsen | |

OTHER PUBLICATIONS

"Gardeners Often Build Their Potting Bench Themselves," http://aboutbenches.com/article/garden-potting-benches/ available as early as Jun. 19, 2010 per www.internetarchive.org (3 pages).

Office Action from Canadian Patent Application No. 2,768,778, mailed Nov. 6, 2012 (3 pages).

"World Zone Potting Bench with Drop Leaf", http://www.gadgetgrid.com/2008/03/13world-zone-potting-bench-with-drop-leaf/, Mar. 13, 2008 (3 pages).

"How to Build a Cedar Potting Bench", http://www.familyhandyman.com/DIY-Projects/Outdoor-Projects/Garden/Garden-Projeces/how-to-build-a-cedar-potting-bench, printed on Dec. 21, 2012 (4 pages).

Office Action from Canadian Patent Application No. 2,768,778, mailed Mar. 14, 2013 (4 pages).

Office Action dated Jul. 3, 2012 issued in Canadian Patent Application No. 2,768,778, 3 pages.

Office Action dated Dec. 12, 2012 issued in Canadian Patent Application No. 2,792,139, 3 pages.

Forever Redwood, "Eli's Potting Benches," http://www.foreverredwood.com/eli-s-potting-bench-1.html, at least as early as Dec. 2012, 2 pages.

Pending U.S. Appl. No. 29/468,421, filed Sep. 30, 2013, entitled Potting Bench, pp. 1-14.

* cited by examiner

POTTING BENCH

BACKGROUND

A potting bench is a piece of furniture that includes a work surface for use in performing small gardening tasks, such as potting or transplanting seedlings and plants. A potting bench also includes spaces for storing potting materials and potting tools, such as soil, compost, pots, trowels, rakes and spades.

Potting benches are made of weather-resistant materials because they can be exposed or partially exposed to the outdoor elements. For example, potting benches can be made of cedar, teak or other man made materials, such as plastic.

The discussion above is merely provided for general background information and is not intended to be used as an aid in determining the scope of the claimed subject matter.

SUMMARY

A potting bench or workstation includes an upper frame section and a lower frame section. The lower frame section is defined by a vertically oriented first front support, vertically oriented first and second rear supports, vertically oriented first and second front supports, vertically oriented first and second rear supports, and a multi-configurable work surface. The work surface includes a fixed section having a first end and a second end, an extendable section rotatably coupled to the first end of the fixed section and configurable into a lowered position and a raised position and a removable section configurable into a user work position and a stowed position. The first end of the removable section is located adjacent to the second end of the fixed section in the user work position and the removable section is supported on a support hook mounted on a side wall located between the second front support and the second rear support in the stowed position.

The vertically oriented first and second front supports have a height that is less than a height of the vertically oriented first and second rear supports coupled to the third and fourth rear supports. The work surface is positioned on top of the vertically oriented first and second front supports and adjacent top ends of the vertically oriented first and second rear supports. The potting bench also includes a plurality of horizontally oriented bars extending from the first rear support to the second rear support and vertically spaced apart above the work surface. A plurality of accessory bins are each coupled to one of the plurality of bars and include a vessel portion and a coupling portion. The coupling portion has an arcuate shape that corresponds with a contour of each of the plurality of horizontally oriented bars.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Embodiments of the disclosure describe a potting bench. The potting bench is a workstation for storing, shelving, potting, transplanting and seeding new plants without the added bending and back strain associated with gardening. The potting bench can be located in any space where plants are cared for. For example, a potting bench can be located indoors, such as in a greenhouse, a shed, a basement, a garage, or located outdoors, such as on a porch or adjacent to a shed or garage. The potting bench includes an upper frame section and a lower frame section. The lower frame section provides a multi-configurable work surface for seeding, potting and watering plants and both the upper and lower frame sections include a variety of storage compartments, storage elements and shelves to store potting or gardening equipment.

More specifically, the lower frame section includes the multi-configurable work surface having a removable section for accessing a removable mixing box. When removed, the removable section of the work surface can be placed in a stowed position by hanging the work surface on a support hook attached to a side wall of the lower frame section of the potting bench. The upper frame section provides a plurality of horizontally aligned rods for supporting a plurality of accessory bins.

FIGS. 1-7 illustrate perspective, top, bottom, front, back, right side and left side views of a first configuration of a potting bench 100 according to one embodiment. FIGS. 8-14 illustrate perspective, top, bottom, front, back, right side and left side views of a second configuration of the potting bench 100 according to another embodiment.

Figure 4:
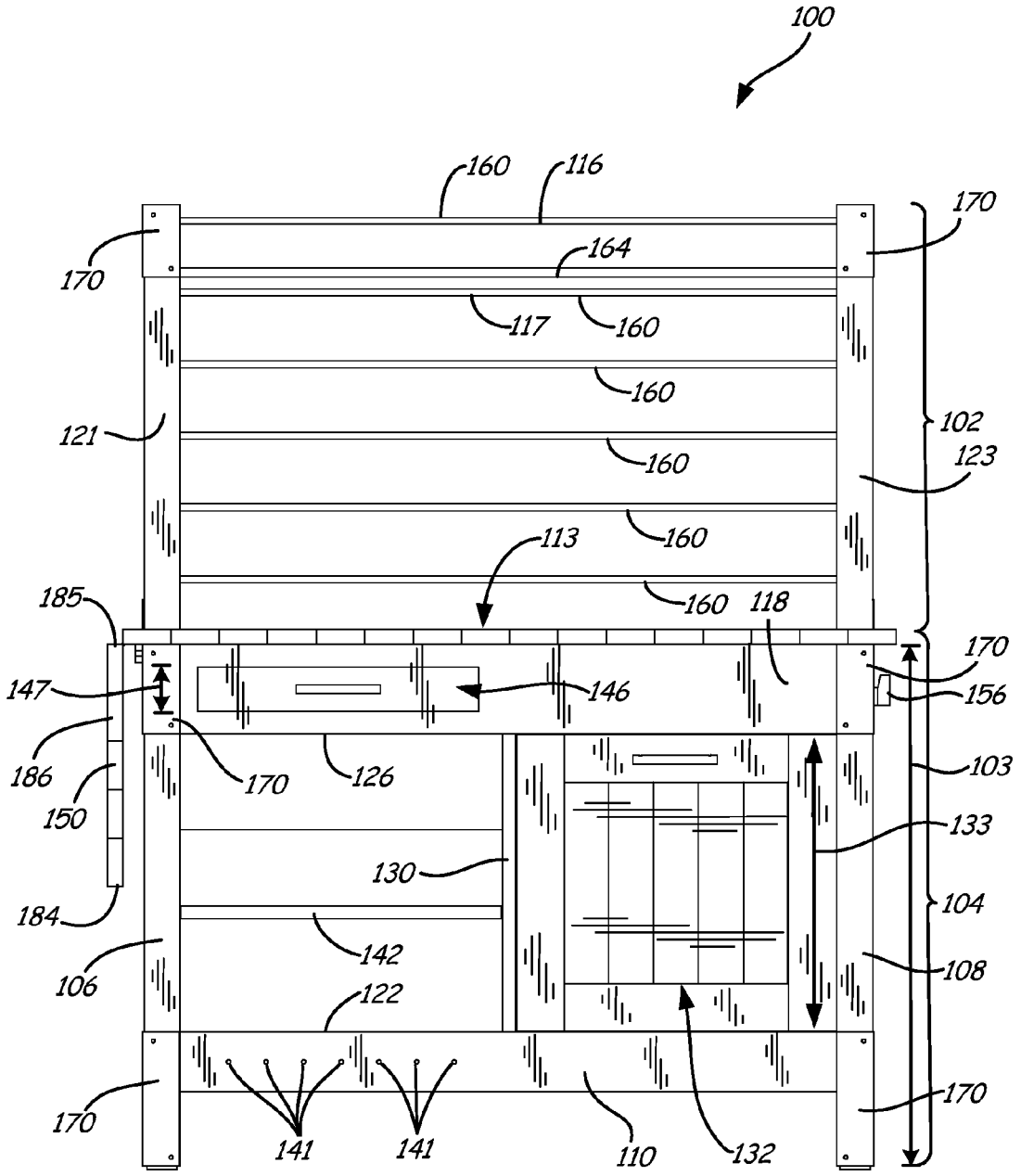
FIG. 4 illustrates a front view of the potting bench illustrated in FIG. 1.

Potting bench 100 includes an upper frame section 102 and a lower frame section 104. Lower frame section 104 includes vertically oriented first and second front supports 106 and 108 and vertically oriented first and second rear supports 107 and 109 of which all four supports 106, 107, 108 and 109 are of substantially the same height 103 (FIG. 4). Upper frame section 104 includes vertically oriented third and fourth rear supports 121 and 123. The bottom ends of third and fourth rear supports 121 and 123 are coupled to top ends of first and second rear supports 107 and 109, respectively. Therefore, the height 103 of vertically oriented first and second front supports 106 and 108 is less than a height 105 (FIG. 5) of the vertically oriented first and second supports 107 and 109 of lower frame section 102 coupled to the vertically oriented third and fourth rear supports 121 and 123 of upper frame section 104.

A first side of lower section 104 is defined by vertically oriented first front support 106 and vertically oriented first rear support 107. A second side of lower section 104 is defined by vertically oriented second front support 108 and vertically oriented second rear support 109. A bottom of lower frame section 104 is defined at least by a lower front panel 110 and a lower rear panel 112. Both lower front panel 110 and lower rear panel 112 are horizontally oriented and located substantially perpendicular to front supports 106 and 108 and rear supports 107 and 109. Lower front panel 110 extends between first front support 106 and second front support 108, while lower rear panel 112 extends between first rear support 107 and second rear support 109. The top of lower frame section 104 is defined by multi-configurable work surface 113.

A first side of upper frame section 102 is defined by third rear support 121 and a second side of upper frame section 102 is defined by fourth rear support 123. A bottom of upper frame section 102 is defined by a horizontally oriented bottom panel 114 and a top of the upper frame section 102 is defined at least by a top of third rear support 121 and a top of fourth rear support 123.

Lower frame section 104 includes an upper front panel 118 and an upper rear panel 120. Upper front panel 118 extends between first front support 106 and second front support 108. Upper rear panel 120 extends between first rear support 107 and a central wall 130. In a vertical plane, central wall 130 extends between top edges 122 and 124 of lower front and rear panels 110 and 112 and bottom edges 126 and 128 of upper front and rear panels 118 and 120. In a horizontal plane, central wall 130 connects lower front panel 110 to lower rear panel 112 and upper front panel 118 to upper rear panel 120.

Figure 3:
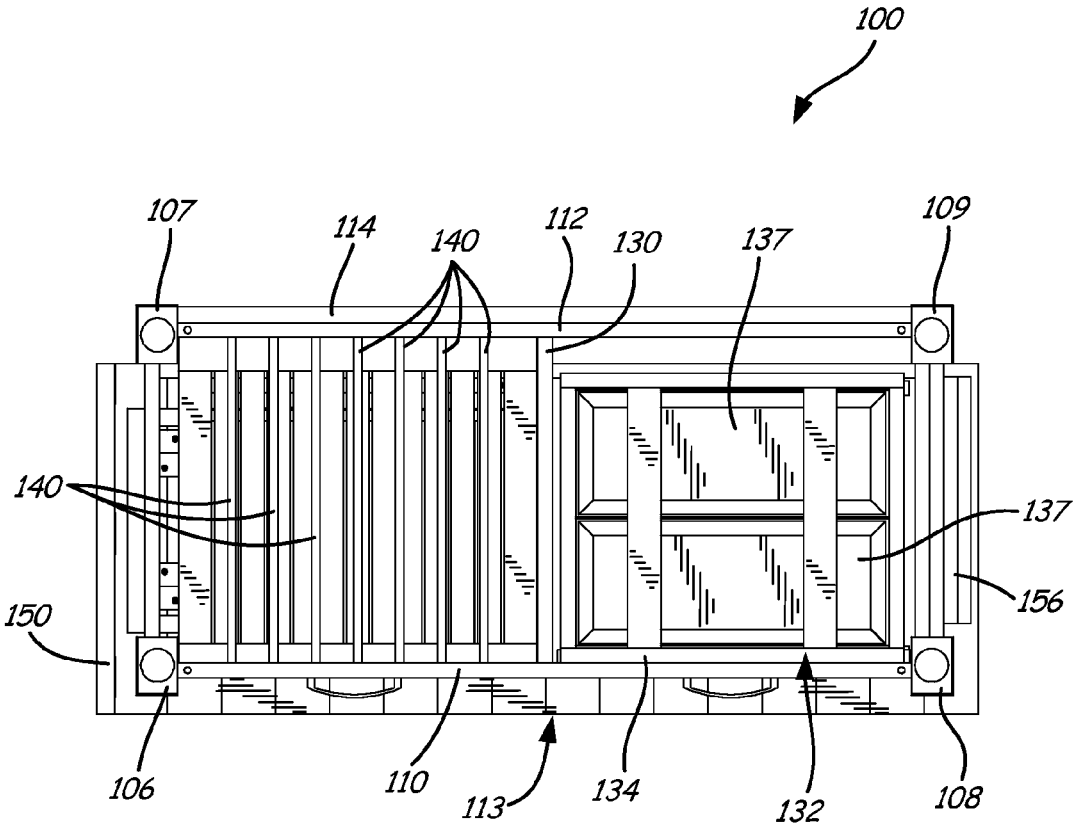
FIG. 3 illustrates a bottom view of the potting bench illustrated in FIG. 1.
Figure 15:
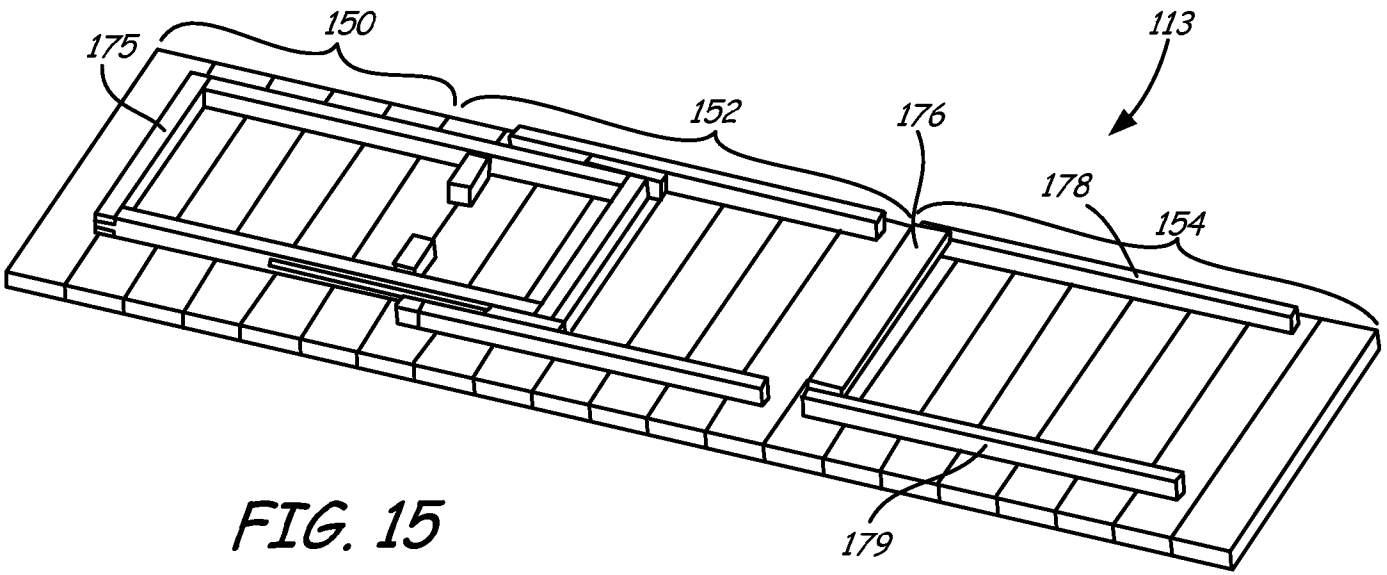
FIG. 15 illustrates a bottom perspective view of the work surface of the potting bench illustrated in FIGS. 1 and 8 where an extended section is in a raised position and a removable section is in a user work position.

Lower frame section 104 of potting bench 100 includes a first compartment 132 defined between central wall 130 and second front support 108 and second rear support 109. First compartment 132 is a pull-out compartment and includes a support structure 134 (FIG. 3). Support structure 134 is coupled to central wall 130, second front support 108 and second rear support 109 by a plurality of drawer slides (hidden from view). First compartment 132 includes a compartment height 133 (FIG. 4) and is configured to contain one or more bins 137 (FIGS. 3 and 15) for holding potting material. For example and as illustrated in FIGS. 3 and 15, first compartment 132 can hold two bins, such as two metal bins, that each hold up to 30-quarts or 40 pounds of soil, sand or compost. Each bin can include a lid to help maintain an optimal level of moisture in the potting material.

Between first front support 106 and first rear support 107 and adjacent to central wall 130, lower frame section 104 of potting bench 100 includes a lower shelf 138. Lower shelf 138 is made of a plurality of rods 140 that extend between lower front panel 110 and lower rear panel 112. Rods 140 of lower shelf 138 provide a support surface that allows objects stored on the surface to drain to the ground. As illustrated, the ends 141 and 143 of each rod 140 are positioned along lower front and rear panels 110 and 112, respectively.

Also, lower section 104 of potting bench 100 includes an upper adjustable shelf 142 located between first front support 106 and first rear support 107 and adjacent to central wall 130. Upper adjustable shelf 142 is positioned adjacent to a back panel 144 that extends between second rear support 107 and central wall 130. Upper adjustable shelf 142 can be positioned at three different levels between lower front and rear panels 110 and 122 and upper front and rear panels 118 and 120 and as denoted by the apertures located in first front and rear supports 106 and 107 illustrated in FIG. 1.

Figure 8:
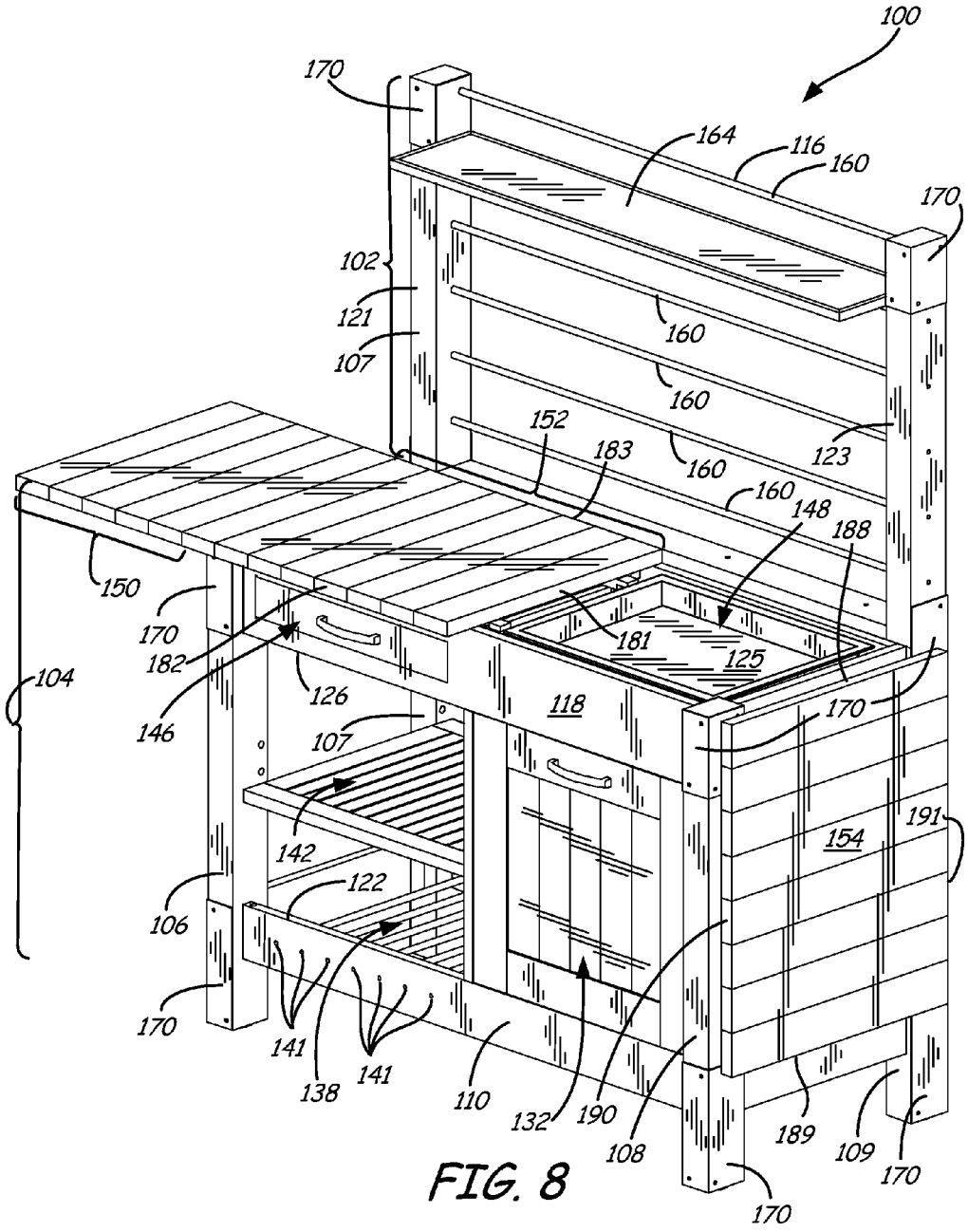
FIG. 8 illustrates a perspective view of another configuration of the potting bench according to another embodiment.
Figure 9:
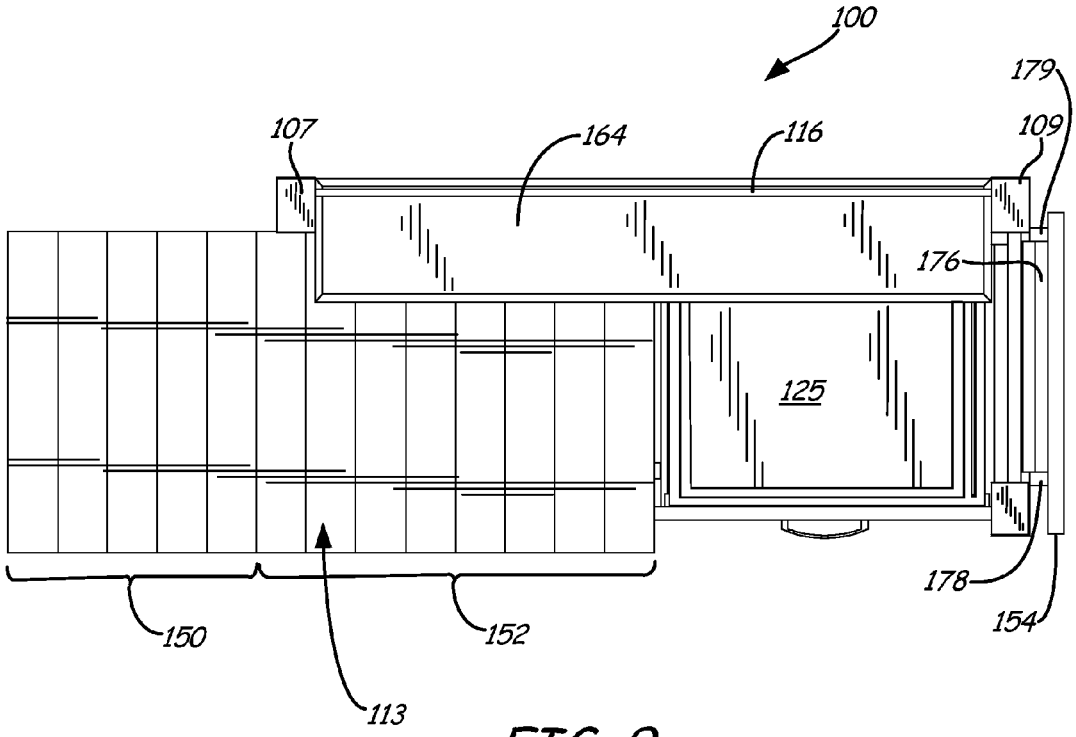
FIG. 9 illustrates a top view of the potting bench illustrated in FIG. 8.
Figure 10:
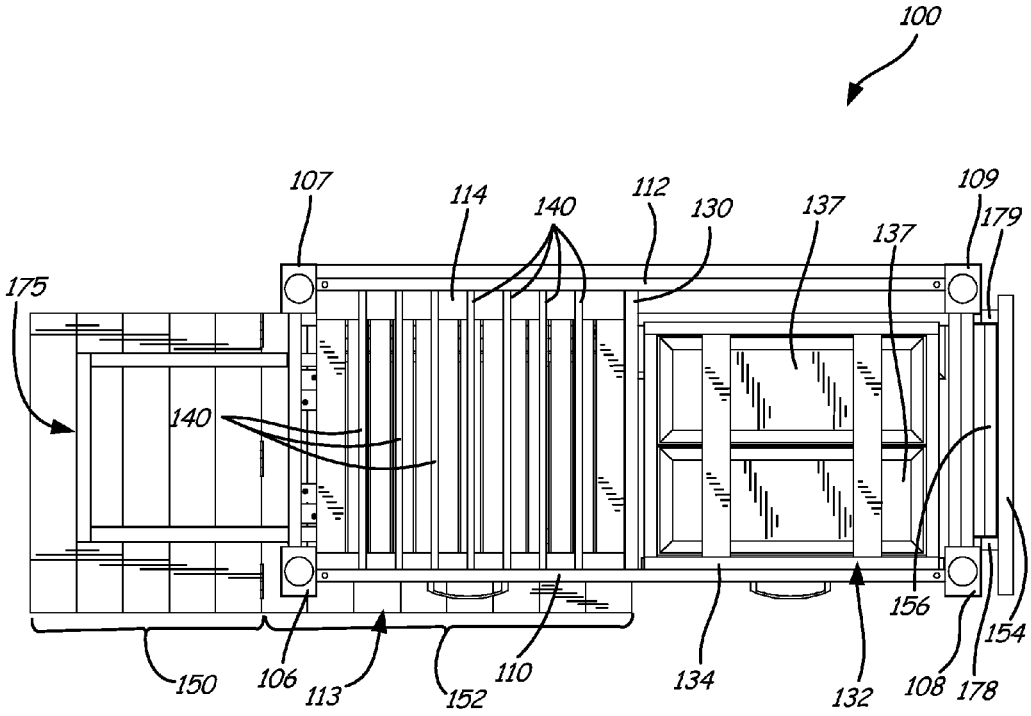
FIG. 10 illustrates a bottom view of the potting bench illustrated in FIG. 8.

Lower frame section 104 of potting bench 100 includes a second compartment 146 and a third compartment 148 (FIGS. 8 and 9). A front of second compartment 146 is defined by upper front panel 118, a back of second compartment 146 is defined by upper rear panel 120, a first side of second compartment 146 is defined by first front support 106 and first rear support 107 and a second side of second compartment 146 is located adjacent to third compartment 148. Second compartment 146 is a pull-out compartment and includes a height 147 that is smaller or shallower than height 133 of first compartment 132. Second compartment 146 is configured to store smaller gardening objects than those gardening objects that can be stored in first compartment 132, stored on lower shelf 138 or stored on upper shelf 142.

A front of third compartment 148 is defined by upper front panel 118, a back of third compartment 148 is defined by upper rear panel 120, a first side of third compartment 148 is adjacent second compartment 146 and a second side of third compartment 148 is defined by a side wall 158 between second front support 108 and second rear support 109. Third compartment 148 is a fixed storage compartment and is located under work surface 113. In the embodiments illustrated in FIGS. 1-14, third compartment 148 is configured to hold or house a removable mixing bin 125 for mixing together different types of potting material and the like. For example, compost and soil from bins 137 can be mixed together in mixing bin 125 and used for seeding, transplanting and potting plants.

Figure 1:
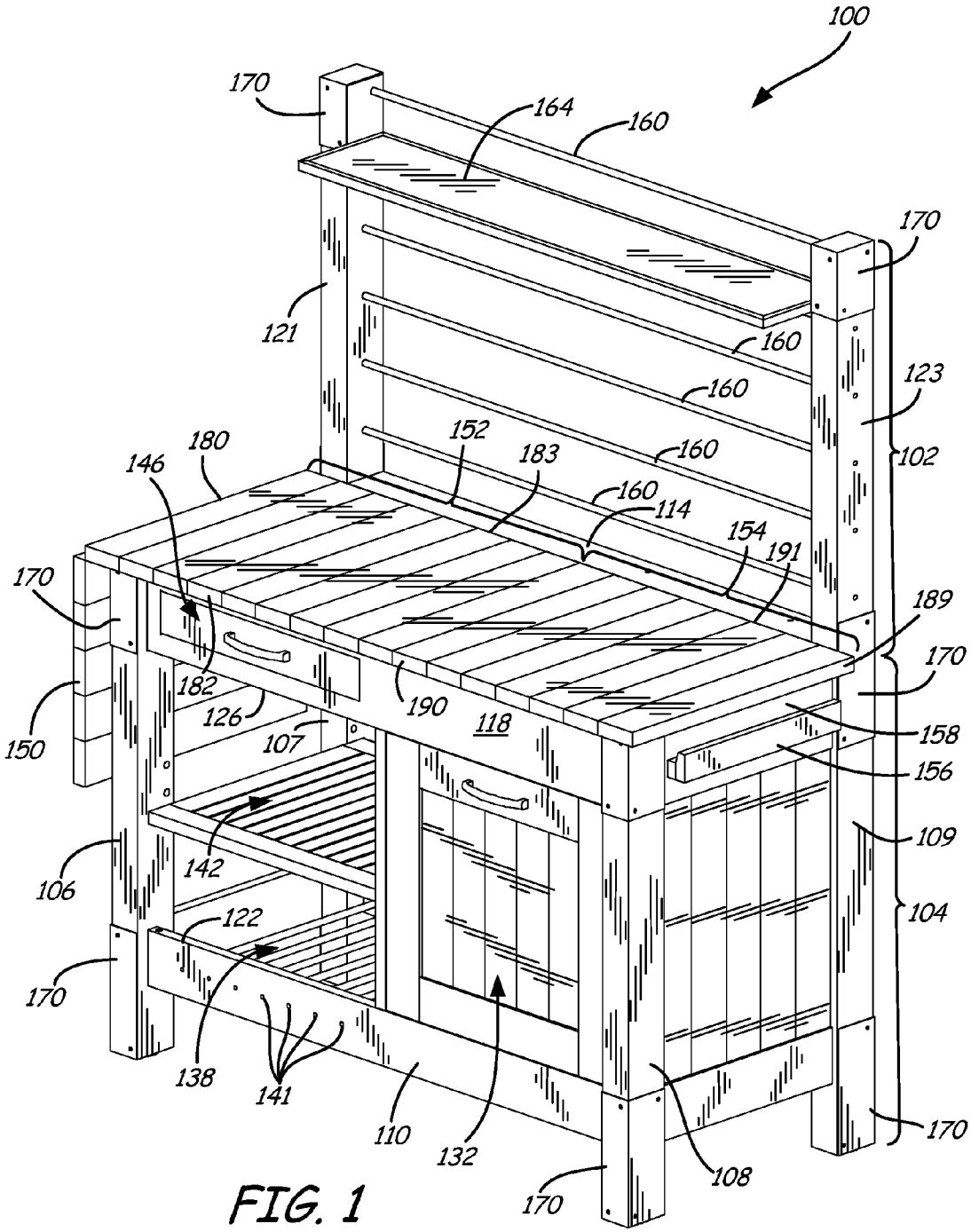
FIG. 1 illustrates a perspective view of one configuration of a potting bench according to one embodiment.
Figure 2:
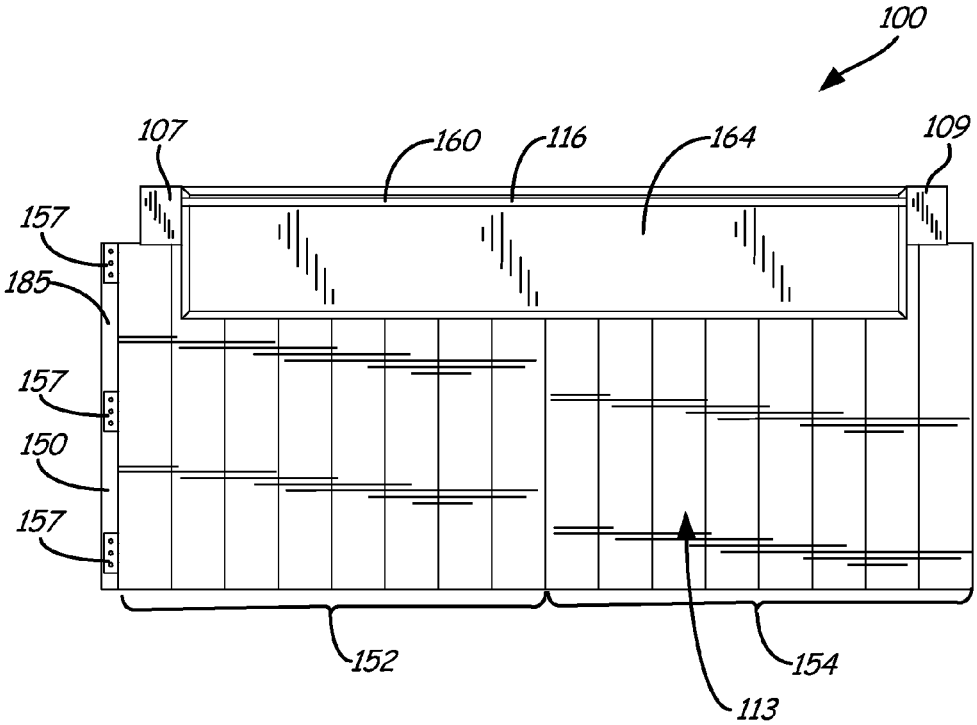
FIG. 2 illustrates a top view of the potting bench illustrated in FIG. 1.
Figure 5:
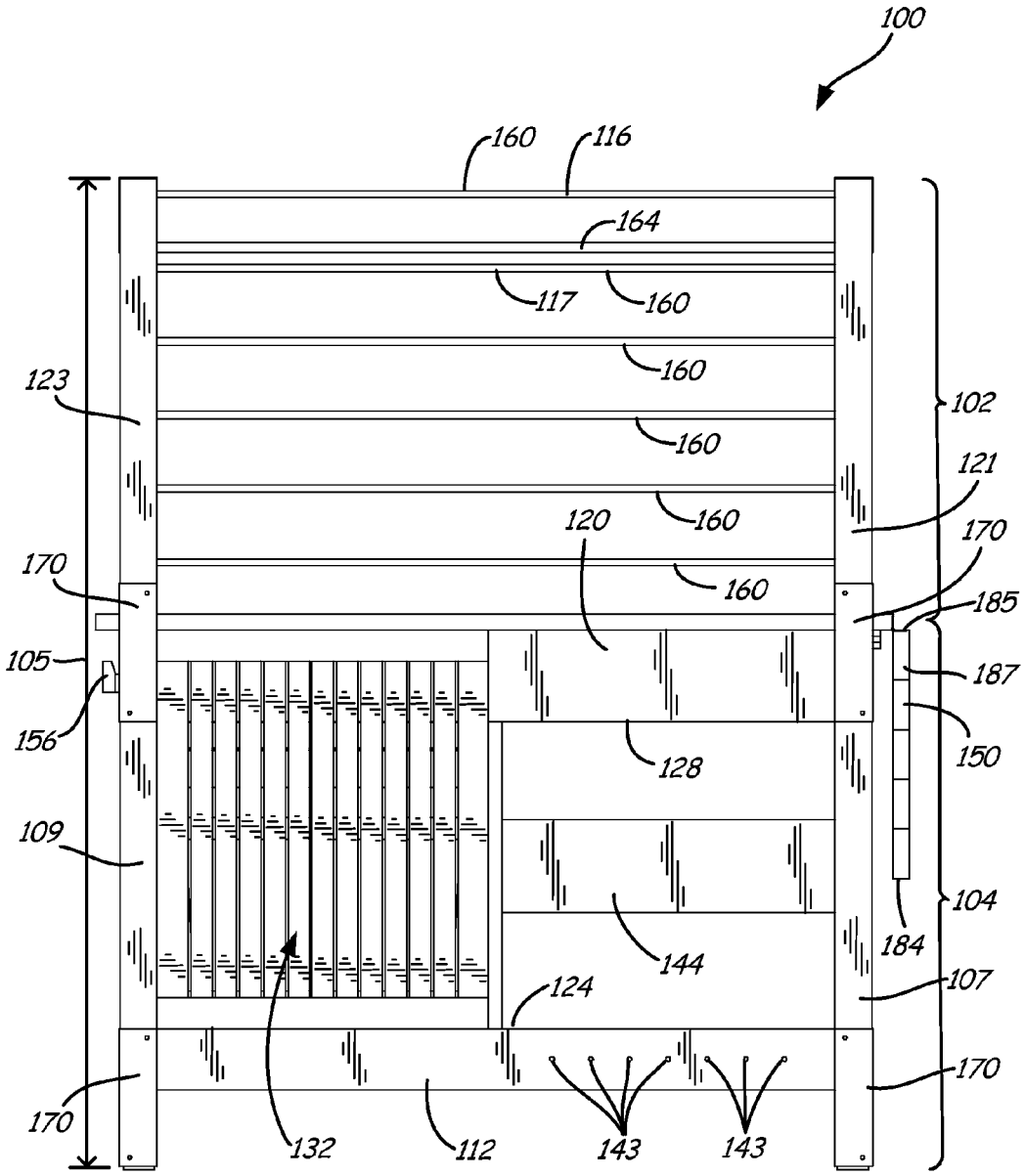
FIG. 5 illustrates a back view of the potting bench illustrated in FIG. 1.
Figure 6:
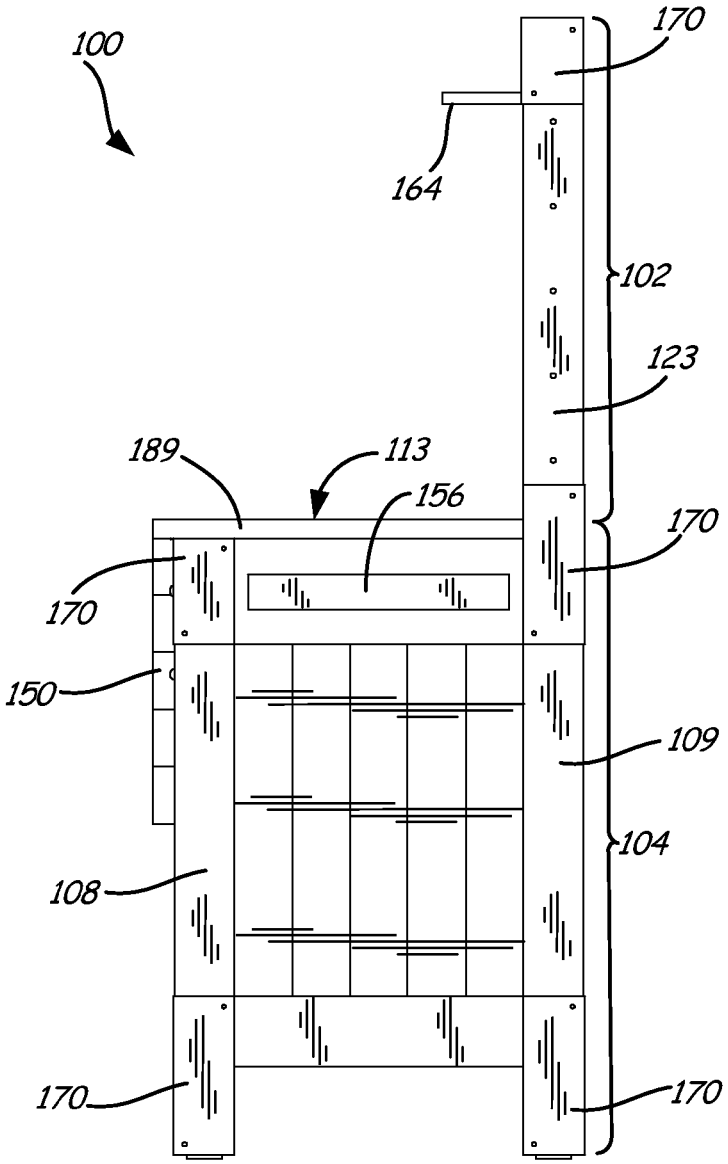
FIG. 6 illustrates a right side view of the potting bench illustrated in FIG. 1.
Figure 7:
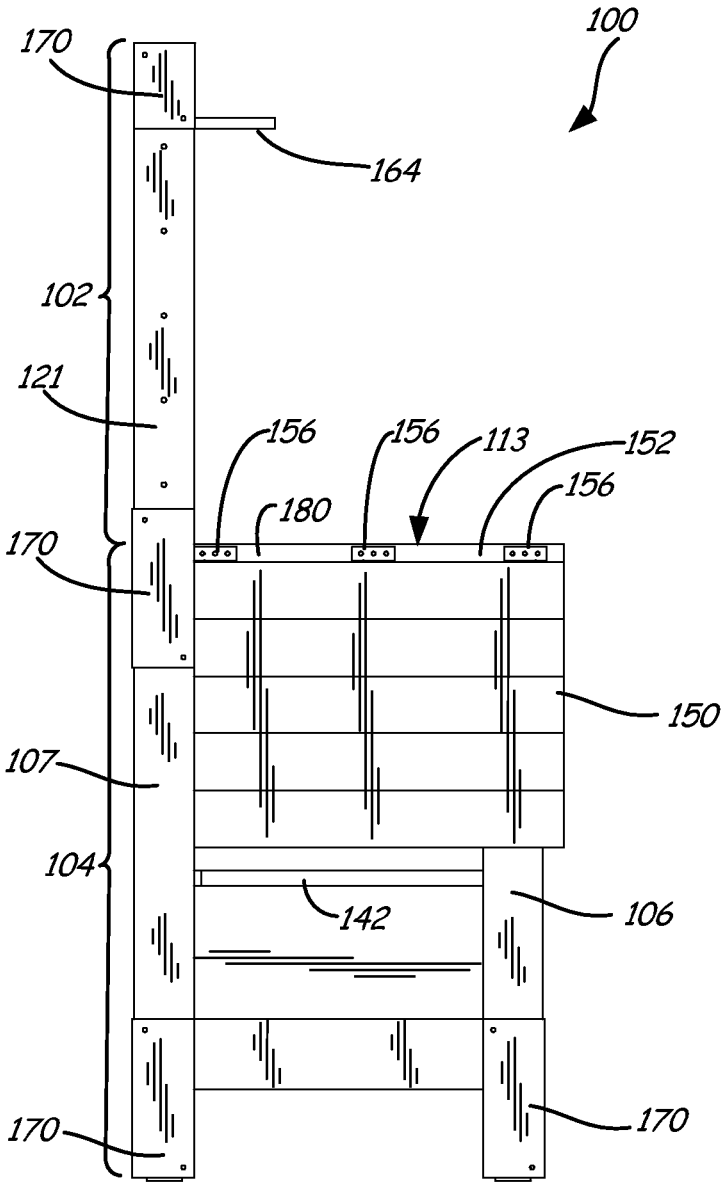
FIG. 7 illustrates a left side view of the potting bench illustrated in FIG. 1.

The work surface 113 of lower section 104 can be configured into multiple different positions or configurations and includes multiple different sections or portions. Work surface 113 includes an extended section or portion 150, a fixed section or portion 152 and a removable section or portion 154. Fixed section 151 includes a first end 180 (FIG. 1), a second end 181 (FIG. 8), a front end 182 (FIGS. 1 and 8) and a back end 183 (FIGS. 1 and 8). Extended section includes a first end 184 (FIGS. 4 and 5), a second end 185 (FIGS. 4 and 5), a front end 186 (FIG. 4) and a back end 187 (FIG. 5). Removable section 154 includes a first end 188 (FIG. 8), a second end 189 (FIGS. 1, 6 and 8), a front end 190 (FIGS. 1 and 8) and a back end 191 (FIGS. 1 and 8).

A bottom side of fixed section 152 is fixed to first front support 106, first rear support 107, upper front panel 118 and upper rear panel 120. Second end 185 of extended section 150 is rotatably coupled to first end 180 of fixed portion 152 by a plurality of hinges 157. In one configuration and as illustrated in FIGS. 1-7, extended portion 150 is positioned in a lowered position such that a width (defined between first end 184 and second 185) of extended portion 150 is oriented along a plane that is substantially perpendicular to a plane oriented along a width (defined between first end 180 and second end 181) of fixed portion 152. In another configuration and as illustrated in FIGS. 8-14, extended portion 150 is positioned in a raised position such that second end 185 is located adjacent to first end 180 of fixed section 152. In other words, the width of the extended section 150 is oriented along or in alignment with a continuous plane of the width of fixed section 152. To position extended section 150 into a raised position, extended section 150 is rotated by hinges 157 such that second end 185 of extended section is positioned adjacent first end 180 of fixed section 152. A sliding member 175 (FIGS. 10-12 and 14) is pulled out from under fixed section 152 to hold extended section 150 in place.

Removable section 154 of work surface 113 is removably coupled to lower section 104 of potting bench 100. In a first configuration and as illustrated in FIGS. 1-7, removable section 154 is shown in a user work position for use as a work surface. In this configuration, a width of removable section 154 is oriented along or in alignment with a continuous plane of the width of fixed section 152 such that first end 188 of removable section 154 is located adjacent to second end 181 of fixed section 152. Potting bench 100 includes a support hook 156, which is coupled to and extends along a side wall 158 of potting bench 100. Since removable portion 154 is in a user work position in FIGS. 1-7, support hook 156 is visible. Side wall 158 extends between and couples the second front support 108 to the second rear support 109. In this configuration and as illustrated in FIGS. 8-14, support hook 156 is configured to engage with a support flange located on the underside of removable section 154 to support the removable section when it is removed to access third compartment 148. When support hook 156 supports removable section 154, the removable section is in a stowed position.

FIG. 15 illustrates a bottom perspective view of work surface 113 with all other components of potting bench 100 removed. In FIG. 15, extended section 150 is in a raised position and removable section 154 is in a user work position. As illustrated, sliding member 175 is illustrated as being pulled out from below the fixed section 152 to support extended section 150 in the raised position. As also illustrated, removable section 154 includes a front flange 178 (also illustrated in FIGS. 10 and 11), a rear flange 179 (also illustrated in FIGS. 10 and 12) and support flange 176. Ends of support flange 176 are coupled to ends of front flange 178 and rear flange 179 such that there is a spaced distance between support flange 176 and a bottom surface 177 of removable section 154. This spaced distance allows support hook 156 to engage with support flange 176 when removable section 154 is hung in the stowed position.

In the embodiment illustrated in FIGS. 1-7, extended section 150 of work surface 113 is in a lowered position and removable section 154 of work surface 113 is in a user work position. In this configuration, a user can utilize two sections of work surface 113 to perform potting or gardening tasks. In the embodiment illustrated in FIGS. 8-14, extended section 150 of work surface 113 is in a raised position and removable section 154 of work surface 113 is in a stowed position. In this configuration, a user can still utilize two sections of work surface 113 to perform potting or gardening tasks while adding the additional component of accessing third compartment 148, which houses the mixing bin containing potting material. While the user has added the additional component of potting material to the work surface area, the user is still able to complete the tasks of potting, transplanting an seeding with the same amount of work space.

Potting bench 100 can also be configured into a variety of other work surface configurations. For example, in one embodiment, extended section 150 can be in a lowered position and removable section 154 can be in a stowed position. This configuration is useful to a user who desires to access third compartment 148, but only requires a smaller work space for performing potting and gardening tasks. In another embodiment, extended section 150 can be in a raised position and removable section 154 can be in a user work position. This configuration is useful to a user who need not access third compartment 148 and desires a large space for performing potting and gardening tasks.

Figure 11:
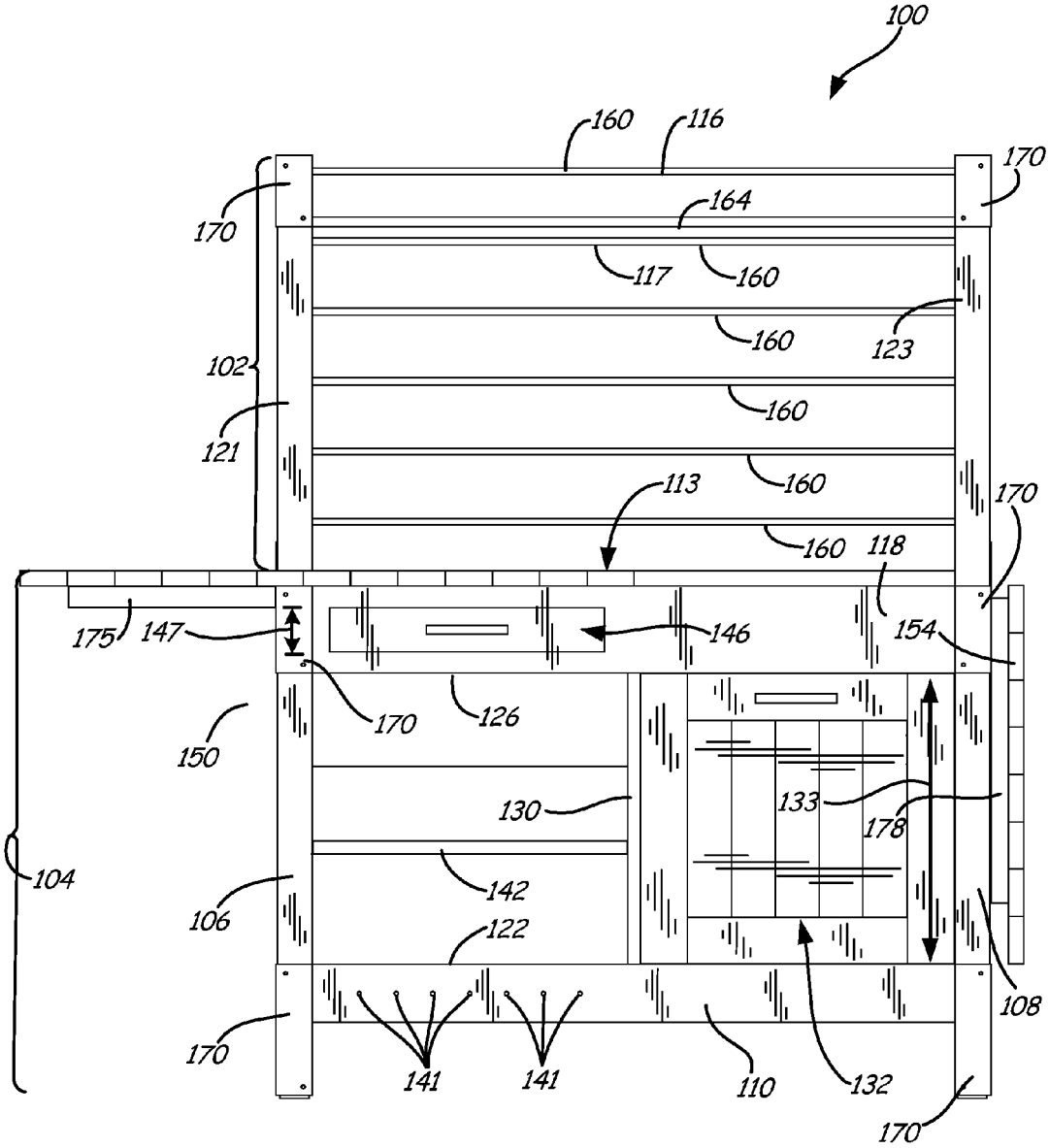
FIG. 11 illustrates a front view of the potting bench illustrated in FIG. 8.
Figure 12:
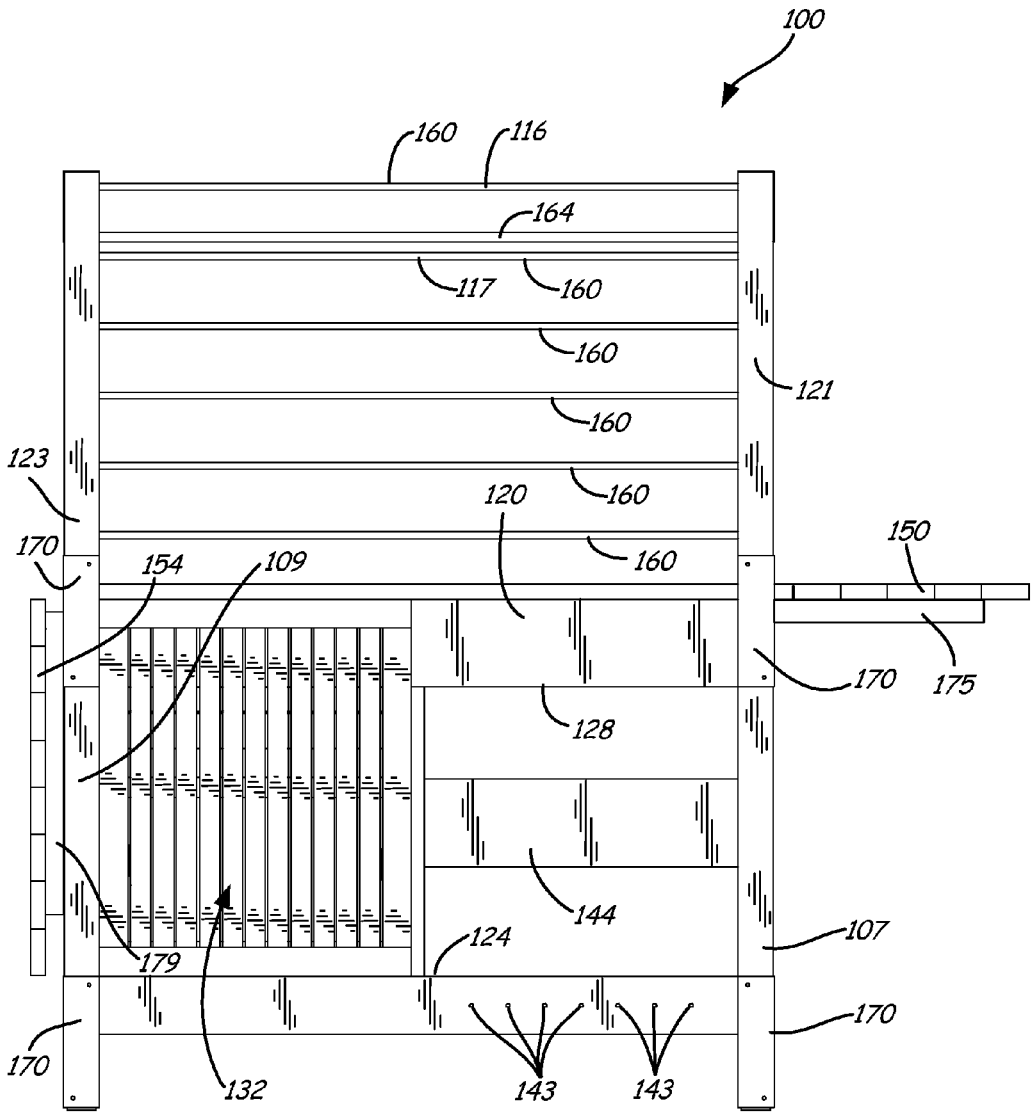
FIG. 12 illustrates a back view of the potting bench illustrated in FIG. 8.
Figure 13:
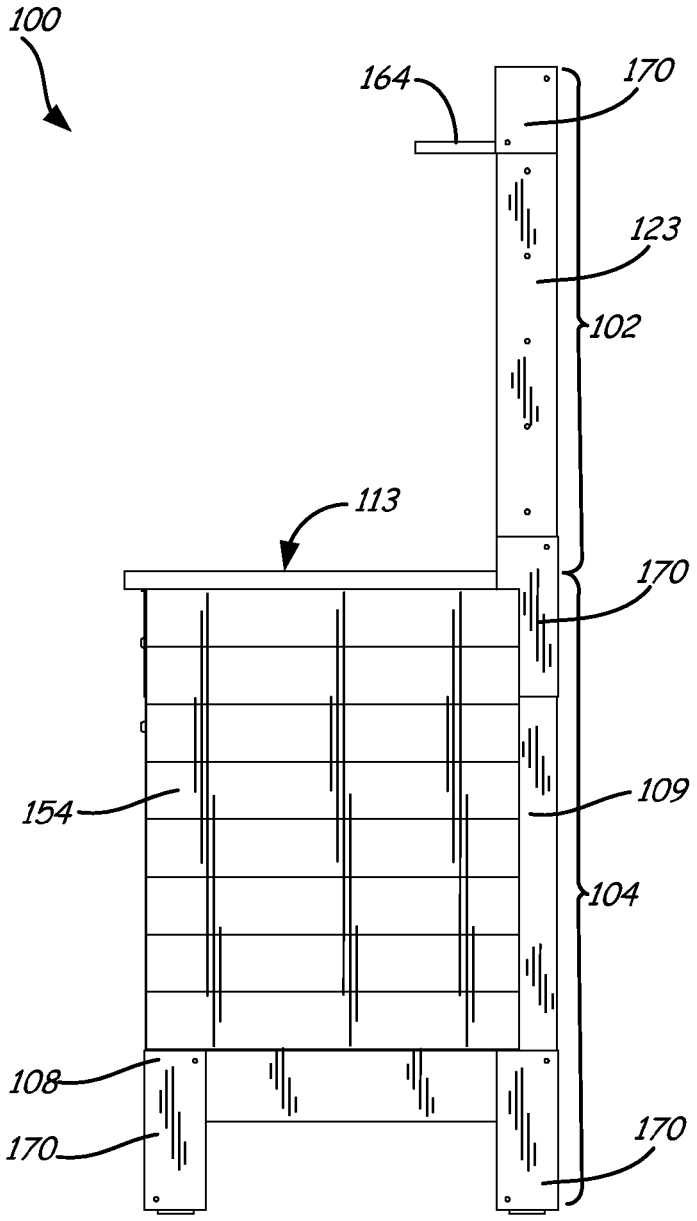
FIG. 13 illustrates a right side view of the potting bench illustrated in FIG. 8.
Figure 14:
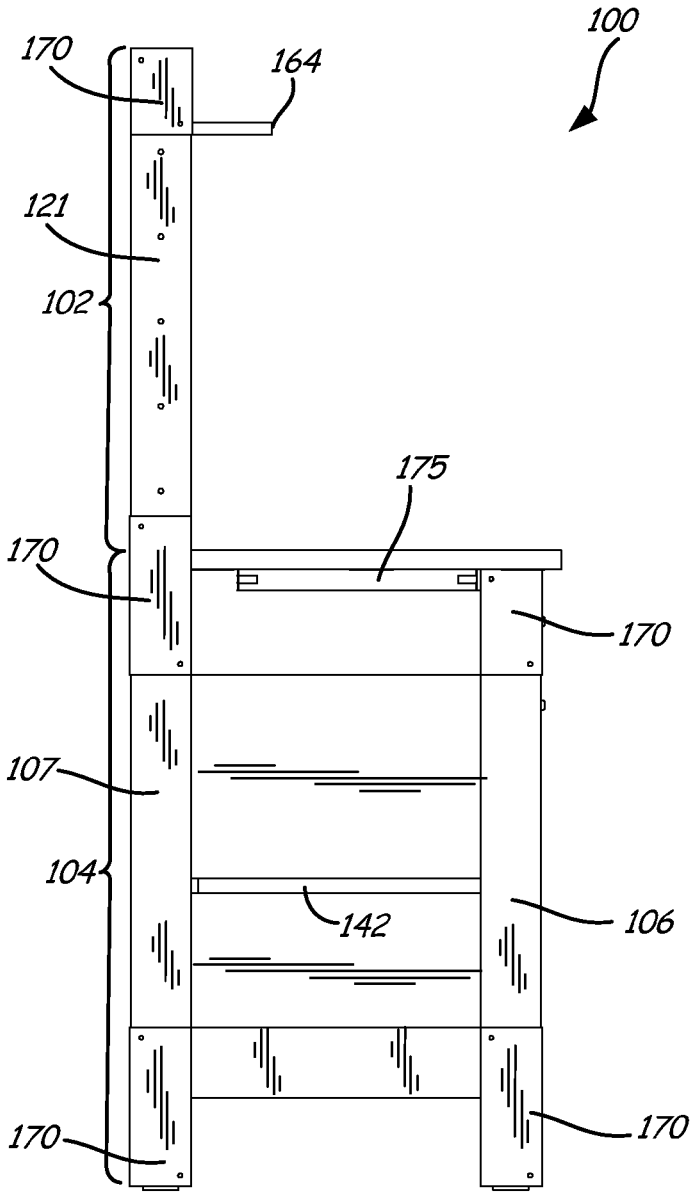
FIG. 14 illustrates a left side view of the potting bench illustrated in FIG. 8.
Figure 17:
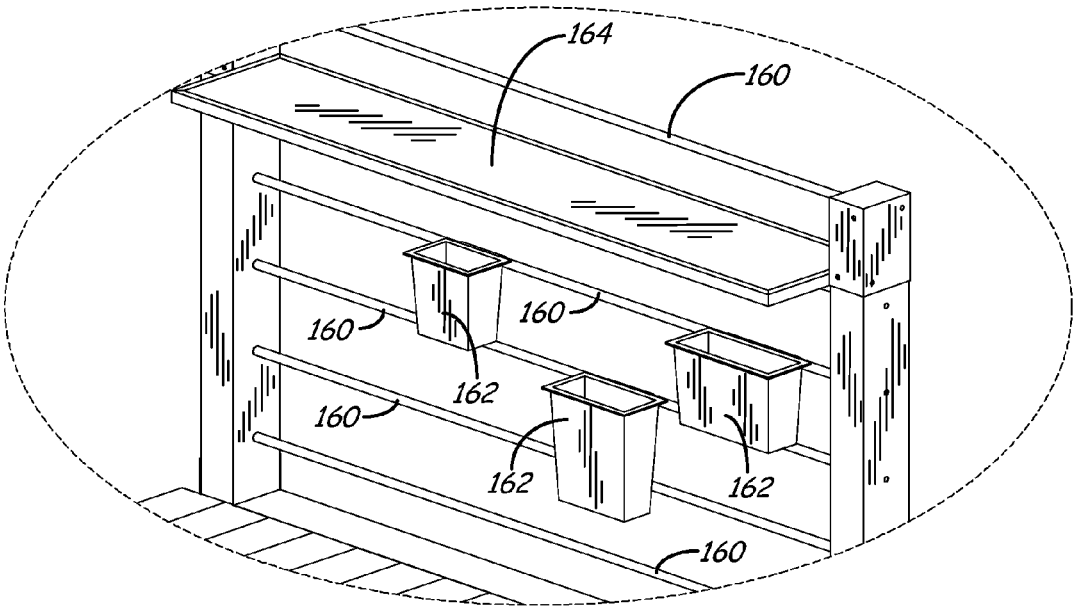
FIG. 17 illustrates an enlarged view of the rack of the potting benches illustrated in FIGS. 1 and 8 including a plurality of accessory bins.

Upper frame section 102 includes a plurality of horizontally oriented bars 160 that extend between the third rear support 121 and fourth rear support 123. The plurality of bars 160 are vertically spaced apart from each other. In particular and as illustrated in FIGS. 4 and 11, potting bench 100 includes six spaced apart bars 160 with an uppermost bar 116. Spaced apart bars 160 are configured to receive and support a plurality of accessory bins 162 as illustrated in the enlarged, partial perspective view of FIG. 17. Accessory bins 162 are configured to retain and organize potting bench related objects, such as tags, tools and seeds, while still allowing the circulation of air between the back side of the potting bench and the front side of the potting bench. While accessory bins 162 are illustrated as having open tops, in one embodiment each or one of the accessory bins 162 can include a lid.

Upper frame section 102 includes an upper frame section shelf 164. Upper frame section shelf 164 extends between third rear support 121 and fourth rear support 123 and is positioned between two of the plurality of vertically spaced apart bars 160: uppermost bar 116 and the next closest bar 117. Shelf 164 is configured to provide a support surface for various potting bench related objects, such as pots and tools.

Figure 16:
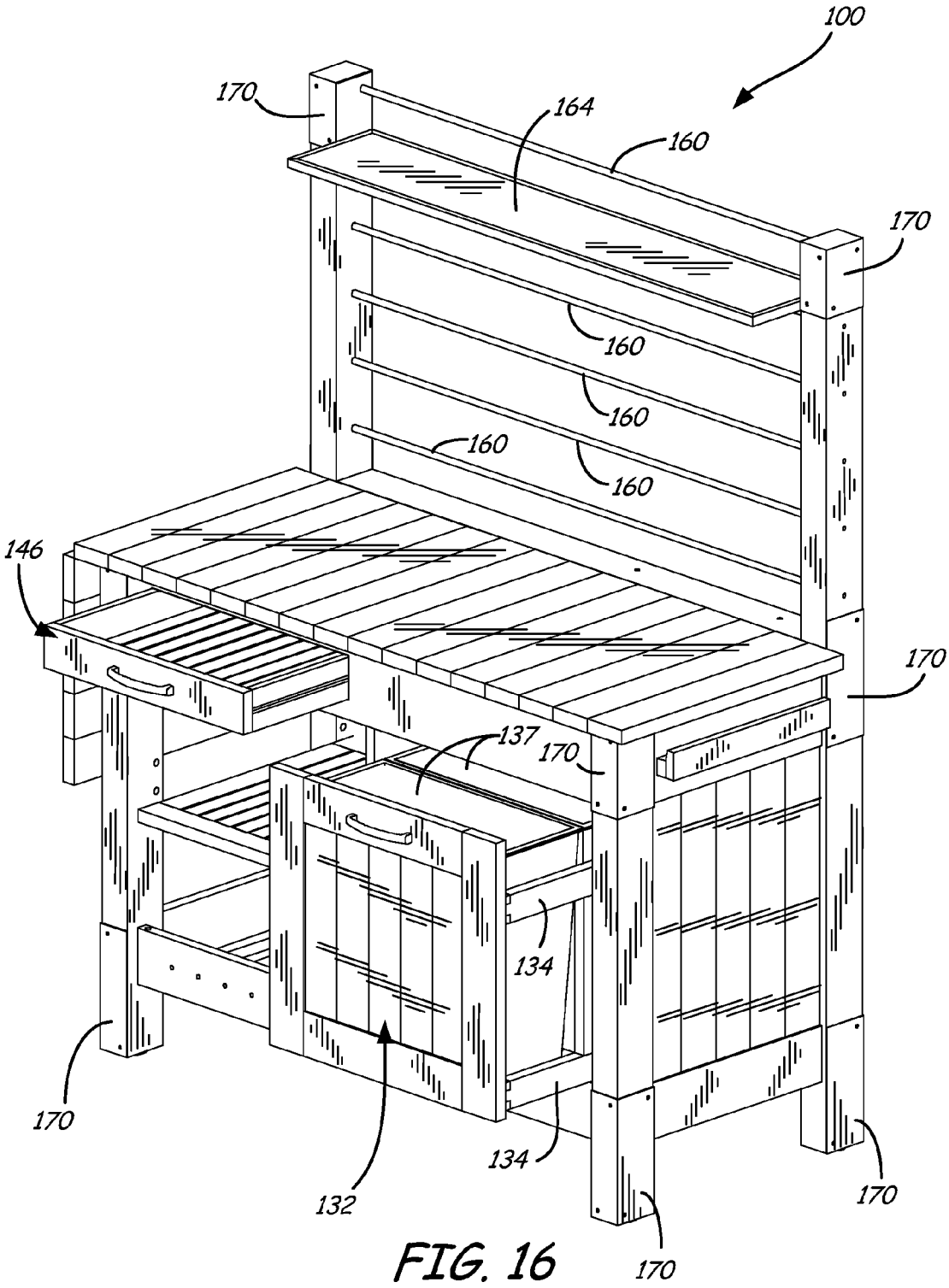
FIG. 16 illustrates a perspective view of the potting bench illustrated in FIG. 8, but with drawers pulled open to show interior spaces.
Figure 18:
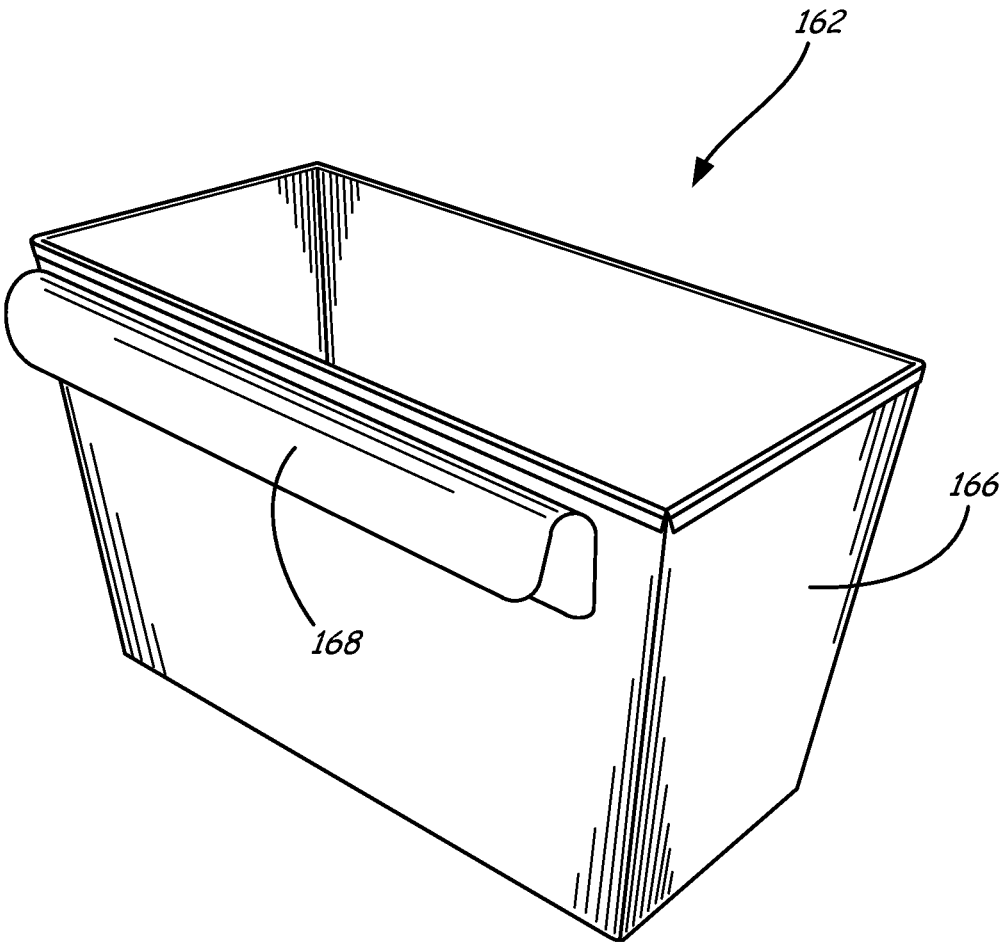
FIG. 18 illustrates a back perspective view of one of the accessory bins illustrated in FIG. 16.

FIG. 18 illustrates a back perspective view of one of the accessory bins 162 illustrated in FIG. 16. Each accessory bin 162 is made of sheet metal and includes a vessel portion 166 and a coupling portion 168. The coupling portion 168 is configured to attach to and allow the vessel portion 166 to hang on one of the plurality of spaced apart bars 160 of upper frame section 102. While the sheet metal of vessel portion 166 is formed using small, tight bends to make squared edges, the sheet metal of coupling portion 168 is arcuate in shape and is formed using a larger bend radius that corresponds with the contour or radius of curvature of each of the plurality of bars 160. A coupling portion 168 extends along and is attached to each back side of each vessel portion 166 by an attachment means, such as spot welding.

As illustrated in FIGS. 1-14, potting bench 100 also includes a plurality of corner protectors 170. The corner protectors 170 are located along portions of first front support 106, first rear support 107, second front support 108, second rear support 109, third rear support 121 and fourth rear support 123. In particular, corner protectors 170 are made of metal and are mounted to potting bench 100 to protect corners of supports 106, 107, 108, 109, 121 and 123 from damage-prone areas. For example, outer bottom sections of the supports, outer sections of the supports where the upper frame section 102 meets the lower frame section 104 and outer top sections of the supports.

The following is an exemplary description of how a user or gardener would go about using potting bench 100 to increase garden productivity and reduce bending and back strain. To plant seeds, a user desires a large work surface area and easy access to potting material. Therefore, the user configures work surface 113 by removing and stowing removable section 154 and raising extendable section 150. To remove removable section 154, the user lifts removable section 154 such that the first end 188 of removable section 154 is separated from the second end 181 of the fixed section 152. To stow removable section 154, the user engages support flange 176 with support hook 156 on side wall 158. To raise extendable section 150, second end 185 of extended section 150 is rotated about first end 180 if fixed section 152 such that the second end 185 of extended section 150 is located adjacent the first end 180 of fixed section 152. The user then slides sliding member 175 our from under fixed section 152 to support extended section 150 in the raised position.

After laying out the requisite amount of seeding trays on extended section 150 and fixed section 152, the user retrieves a trowel or other gardening scooping tool from one of the accessory bins 162. Using the trowel, the user can transfer potting material from each of the bins 137 located in pull-out storage compartment 132 to the mixing bin located in compartment 148. The seed trays now holding newly planted seeds are watered and can be left to grow on the potting bench. For example, seeding trays can be left on work surface 113 after removable section 154 is placed back into a user work position or placed on shelf 164.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A workstation comprising:

an upper frame section;

a lower frame section defined at least by a first front support, a first rear support, a second front support, a second rear support, a planar work surface and a side wall that is located between the second front support and the second rear support and having an exterior facing surface;

a support hook mounted to and protruding from the exterior facing surface of the side wall of the lower frame section;

wherein the work surface of the lower frame section comprises:

a fixed section having a first end and a second end;

an extendable section rotatably coupled to the first end of the fixed section and configurable into a lowered position and a raised position, wherein in the raised position the work surface of the extendable section abuts with and is in alignment with the work surface of the fixed section and wherein in the lowered position the work surface of the extendable section is out-of-alignment from the work surface of the fixed section; and a removable section configurable into a user work position and a stowed position, wherein in the user work position a first end of the work surface of the removable section abuts the second end of the work surface of the fixed section and wherein in the stowed position the work surface of the removable section is separated from the work surface of the fixed section and supported on the support hook mounted on the side wall of the lower frame section.

2. The workstation of claim 1, wherein the upper frame section is defined by a third rear support that has a bottom end coupled to and in alignment with a top end of the first rear support and a fourth rear support that has a bottom end coupled to and in alignment a top end of the second rear support, the upper frame section comprising a plurality of horizontally oriented bars that extend from the third rear support to the fourth rear support and are vertically spaced apart above the work surface.

3. The workstation of claim 2, further comprising a plurality of accessory bins, each accessory bin coupled to one of the plurality of bars.

4. The workstation of claim 3, wherein each accessory bin comprises a vessel portion and a coupling portion, the coupling portion is attached to a back side of the vessel portion and comprises an arcuate shape that corresponds with a contour of each of the plurality of bars.

5. The workstation of claim 2, wherein the upper frame section comprises a shelf extending between the third rear support and the fourth rear support of the upper frame section, wherein the shelf is positioned between two of the plurality of bars.

6. The workstation of claim 1, wherein the lower frame section further comprises a storage compartment located under the removable section of the work surface when the removable section of the work surface is in the user work position.

7. The workstation of claim 1, wherein the removable section comprises a support flange located a spaced distance from a bottom surface of the removable section, wherein the support hook mounted to the side wall of the potting bench engages with the support flange when the removable section is positioned in the stowed position.

8. A potting bench comprising:

vertically oriented first and second rear supports;

vertically oriented first and second front supports;

a side wall located between the second front support and second rear support and having an outwardly facing surface;

a support hook mounted on and protruding from the outwardly facing surface of the side wall;

a work surface positioned at least on top of the vertically oriented first and second front supports and adjacent the top ends of the vertically oriented first and second rear supports, the work surface adapted to support equipment for seeding, potting or watering plants and comprises:

a fixed portion having a first end and a second end;

a removable portion configurable into a user work position and a stowed position, wherein in the user work position the removable portion abuts the second end of the fixed portion and is in alignment with the fixed portion and wherein in the stowed position the removable portion is supported on the support hook mounted on the side wall; and an extendable portion rotatably coupled to the first end of the fixed portion and configurable into a lowered position and a raised position.

9. The potting bench of claim 8, wherein the removable portion includes a support flange located a spaced distance from a bottom surface of the removable section, wherein the support hook mounted to the side wall of the potting bench engages with the support flange when the removable section is positioned in the stowed position.

10. The potting bench of claim 8, further comprising a fixed storage compartment located under the removable portion of the work surface when the removable portion of the work surface is in the user work position.

11. The potting bench of claim 10, further comprising a first pull-out storage compartment located between the fixed storage compartment and the first front support and first rear support.

12. The potting bench of claim 11, further comprising a second pull-out storage compartment located below the fixed storage compartment.

13. The potting bench of claim 8, further comprising vertically oriented third and fourth rear supports, wherein a bottom end of the third rear support is coupled to a top end of the first rear support and a bottom end of the fourth rear support is coupled to a top end of the second rear support and wherein the vertically oriented first and second front supports have a height that is less than a height of the vertically oriented first and second rear supports coupled to the third and fourth rear supports.

14. The potting bench of claim 13, further comprising:

a plurality of horizontally oriented bars extending from the third rear support to the fourth rear support and being vertically spaced apart above the work surface; and a plurality of accessory bins, each accessory bin coupled to one of the plurality of bars and including a vessel portion and a coupling portion, the coupling portion having an arcuate shape that corresponds with a contour of each of the plurality of horizontally oriented bars, the vessel portion adapted to receive at least some of the equipment for seeding, potting or watering plants.

15. The potting bench of claim 14, further comprising a shelf extending from the third rear support to the fourth rear support, the shelf being positioned between two of the plurality of horizontally oriented bars.

16. A method comprising:

obtaining a potting bench with a planar work surface that includes a fixed section, an extendable section and a removable section, the fixed section including a first end and a second end, the extendable section rotatably coupled to the first end of the fixed section and the removable section including a first end that abuts the second end of the fixed section and is in alignment with the fixed section;

removing the removable section of the work surface from the potting bench such that the first end of the removable section is separated from the second end of the fixed section; and stowing the removable section of the work surface on a storage hook mounted to and protruding from an exterior facing surface of a side wall of the potting bench.

17. The method of claim 16, further comprising raising the extended section into a raised position such that the second end of the extended section abuts the first end of the fixed section.

18. The method of claim 16, further comprising attaching at least one accessory bin to one of a plurality of bars located above the work surface of the potting bench.

19. The method of claim 18, wherein attaching the at least one accessory bin comprises engaging an arcuate-shaped coupling portion of the at least one accessory bin to a contour of one of the plurality of bars.

* * * * *